US006769938B2

(12) United States Patent
Eckert et al.

(10) Patent No.: US 6,769,938 B2
(45) Date of Patent: Aug. 3, 2004

(54) MODULAR DEVICE ASSEMBLY WITH A TERMINAL

(75) Inventors: Gunther Eckert, Maxhuette-Haidhof (DE); Reinhard Sangl, Wenzenbach (DE); Winfried Vierling, Neutraubling (DE)

(73) Assignee: Siemens Aktiengesellschaft, Munich (DE)

( * ) Notice: Subject to any disclaimer, the term of this patent is extended or adjusted under 35 U.S.C. 154(b) by 76 days.

(21) Appl. No.: 10/257,447

(22) PCT Filed: Apr. 5, 2001

(86) PCT No.: PCT/DE01/01337

§ 371 (c)(1),
(2), (4) Date: Oct. 11, 2002

(87) PCT Pub. No.: WO01/80267

PCT Pub. Date: Oct. 25, 2001

(65) Prior Publication Data

US 2003/0136657 A1 Jul. 24, 2003

(30) Foreign Application Priority Data

Apr. 13, 2000 (DE) ..... 100 183 514

(51) Int. Cl.[7] ..... H01R 13/502
(52) U.S. Cl. ..... 439/701
(58) Field of Search ..... 439/701, 353, 439/357–359, 394, 607–610, 595–596, 680–681, 686, 953

(56) References Cited

U.S. PATENT DOCUMENTS

| | | | | | |
|---|---|---|---|---|---|
| 5,368,505 | A | * | 11/1994 | Hoolhorst et al. | 439/701 |
| 5,393,242 | A | * | 2/1995 | VanDerStuyf | 439/364 |
| 5,772,475 | A | * | 6/1998 | Lindeberg et al. | 439/701 |
| 5,772,479 | A | | 6/1998 | Fleege et al. | |
| 6,113,415 | A | * | 9/2000 | Bertsch et al. | 439/353 |
| 6,217,364 | B1 | * | 4/2001 | Miskin et al. | 439/358 |

FOREIGN PATENT DOCUMENTS

| | | |
|---|---|---|
| EP | 0 552 113 A1 | 7/1993 |
| EP | 0 758 804 A1 | 2/1997 |
| EP | 0 923 100 A1 | 6/1999 |
| FR | 2 730 855 A | 8/1996 |
| GB | 932580 | 7/1963 |

* cited by examiner

*Primary Examiner*—J. F. Duverne
(74) *Attorney, Agent, or Firm*—Harness, Dickey & Pierce, P.L.C.

(57) ABSTRACT

A modular device comprises a housing and a terminal arranged therein with a clamping screw, a pressure plate and clamping frame, a first recess on the connection side for transversely receiving a busbar passing through the housing and clamping frame, and the insulating gap between the outer edge of the clamping frame within the housing and the outer side of the adjoining closed housing side being smaller than the air insulating gap between the outer edge of the clamping frame in the region of the recess and the outer side of the adjoining housing side.

20 Claims, 4 Drawing Sheets

MODULAR DEVICE ASSEMBLY WITH A TERMINAL

This application is the national phase under 35 U.S.C. § 371 of PCT International Application No. PCT/DE01/01337 which has an International filing date of Apr. 5, 2001, which designated the United States of America and which claims priority on German Patent Application number 100 18 351.4 filed Apr. 13, 2000, the entire contents of which are hereby incorporated herein by reference.

FIELD OF THE INVENTION

The present invention generally relates to modular devices.

BACKGROUND OF THE INVENTION

A modular device of this type, designed as a circuit-breaker, is known from EP 0 552 113 B 1. When arranging such devices in series, there is the problem that the air insulating gap between the exposed conducting parts of adjacent terminals must be maintained in the open region of the busbar connection. The size, in particular the width, of the terminals used is based on this. As a result, the structural size of the modular device, in particular the inner structure, is in turn significantly influenced.

SUMMARY OF THE INVENTION

An embodiment of the present invention is based on an object of providing a modular device which has a terminal and with which an optimized insulating capability in comparison with the prior art is provided for an enlarged receiving space while maintaining the required air insulating gap.

This object may be achieved according to an embodiment of the present invention by the features of claim 1. This provides a modular device, having a housing and a terminal arranged therein with a clamping screw, pressure plate and clamping frame, a first recess on the connection side for transversely receiving a busbar passing through the housing and clamping frame, and the insulating gap between the outer edge of the clamping frame within the housing and the outer side of the adjoining closed housing side being smaller than the air insulating gap between the outer edge of the clamping frame in the region of the recess and the outer side of the adjoining housing side. It was recognized that the terminals previously used were always dimensioned just on the basis of the air insulating gap. However, this is only applicable for dimensioning in the laterally open region of the terminal. The remaining region of the terminal or of the clamping frame within the housing can, however, be widened on account of the good insulating capability of the housing.

In this case, it is favorable if the clamping frame has a narrowing in the region of the recess. In other words, the clamping frame may also be widened in the closed region. Consequently, an increase in the size of the clamping space by several % is possible in a simple way. The width of the clamping frame may in this case be reduced in the region of the narrowing by approximately 0.2 to 3 mm, in particular by 0.5 to 1.5 mm, specifically by about 1.2 mm.

The narrowing may in this case be designed as a recess, for example a milled relief or indentation. This produces a strong clamping frame with a stepless receiving space, which is additionally very stable. Alternatively, the narrowing may be designed as a constriction or deformation. This produces a material-saving clamping frame with a large receiving space.

The side wall thickness of the housing in the region of the recess may be greater than that of the closed region of the housing. This produces good insulation protection in the transitional region, in particular in the region of the leakage path. The modular device is preferably formed as a circuit-breaker or residual-current-operated circuit-breaker.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
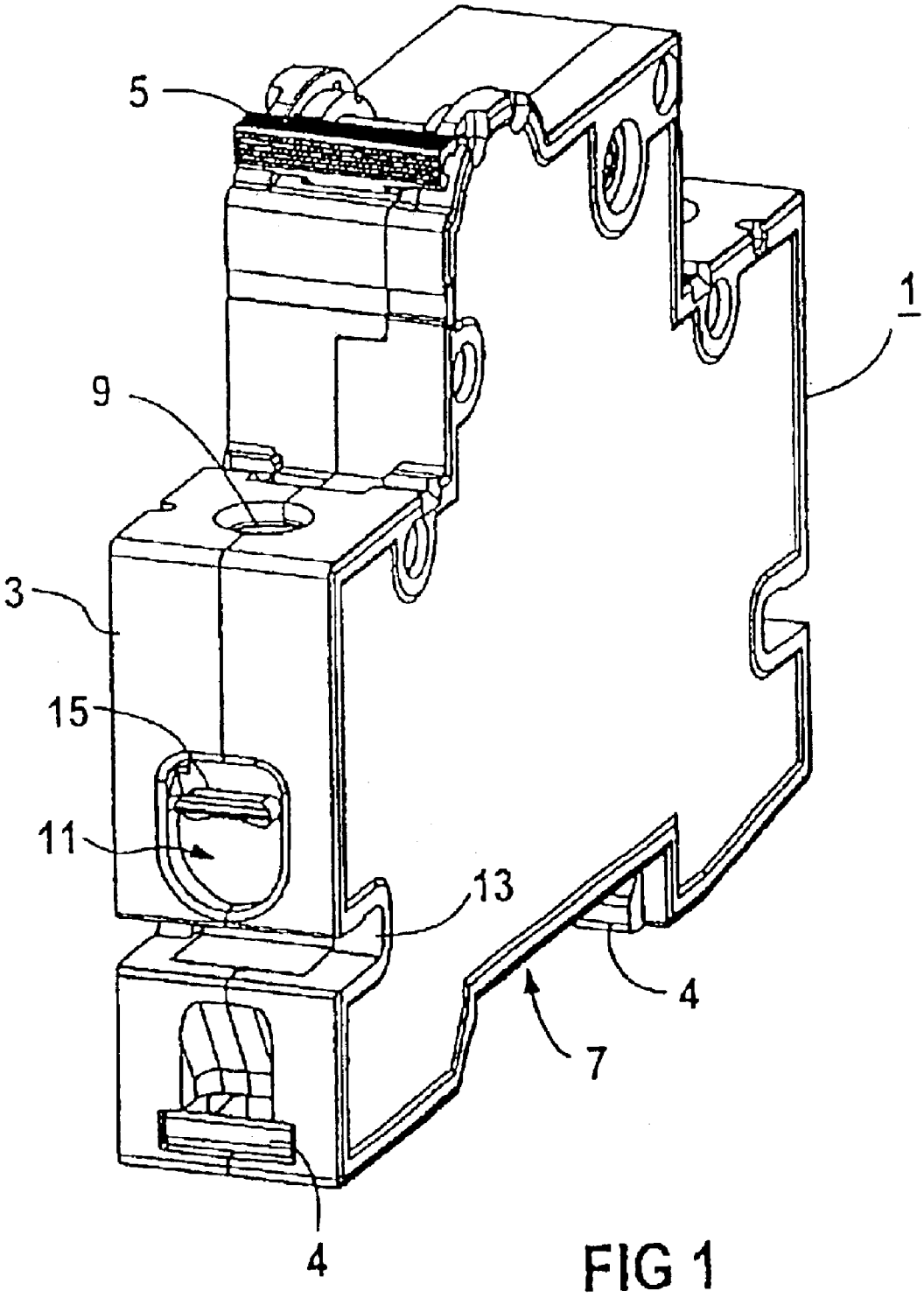
FIG. 1 illustrates a circuit-breaker in a view from outside.

In the figures described below, the same details are provided with the same reference numerals.

FIG. 1 shows a modular device 1, in particular a circuit-breaker or a residual-current-operated circuit-breaker, in a three-dimensional view from outside. The modular device 1 may include any desired functions or internal components. What is of relevant significant to at least one embodiment of the present invention is the design of the terminals or connection terminals. The text which follows substantially describes only one of two, by way of example.

In the configuration as a circuit-breaker, a manual operating crossbar 5 is arranged on the operating end face of the housing 3. In the configuration as a modular device, the housing 3 has a relief 7, with which the modular device can be snap-fitted onto a retaining rail, for example a top-hat rail. The reference numeral 4 designates a fastening device which allow frictional fastening on the top-hat rail but are not described in any more detail. These are generally known from the prior art. On its front and rear sides, the modular device 1 has openings, through which a terminal, which cannot be seen any more precisely in this representation, is accessible and by way of which an external circuit can be connected to the modular device 1.

In this case, the clamping screw of the terminal is accessible via a first opening 9. The connection opening 11 serves for introducing one or more connection wires into the connection space of the terminal. The terminal presently being used is accessible via a further opening, so that what is known as a "3D terminal" is formed. For this purpose, the terminal has the first recess 13, passing transversely through the housing 3 and the clamping frame 21. By way of this first recess 13, a number of modular devices arranged against one another in series can be transversely connected to one another by a common busbar. In principle, a busbar connection of this type is known from EP 0 552 113. Shown in the region of the connection opening 11 is an insulating covering 15, which serves as shock protection for live parts of the terminal.

Figure 2:
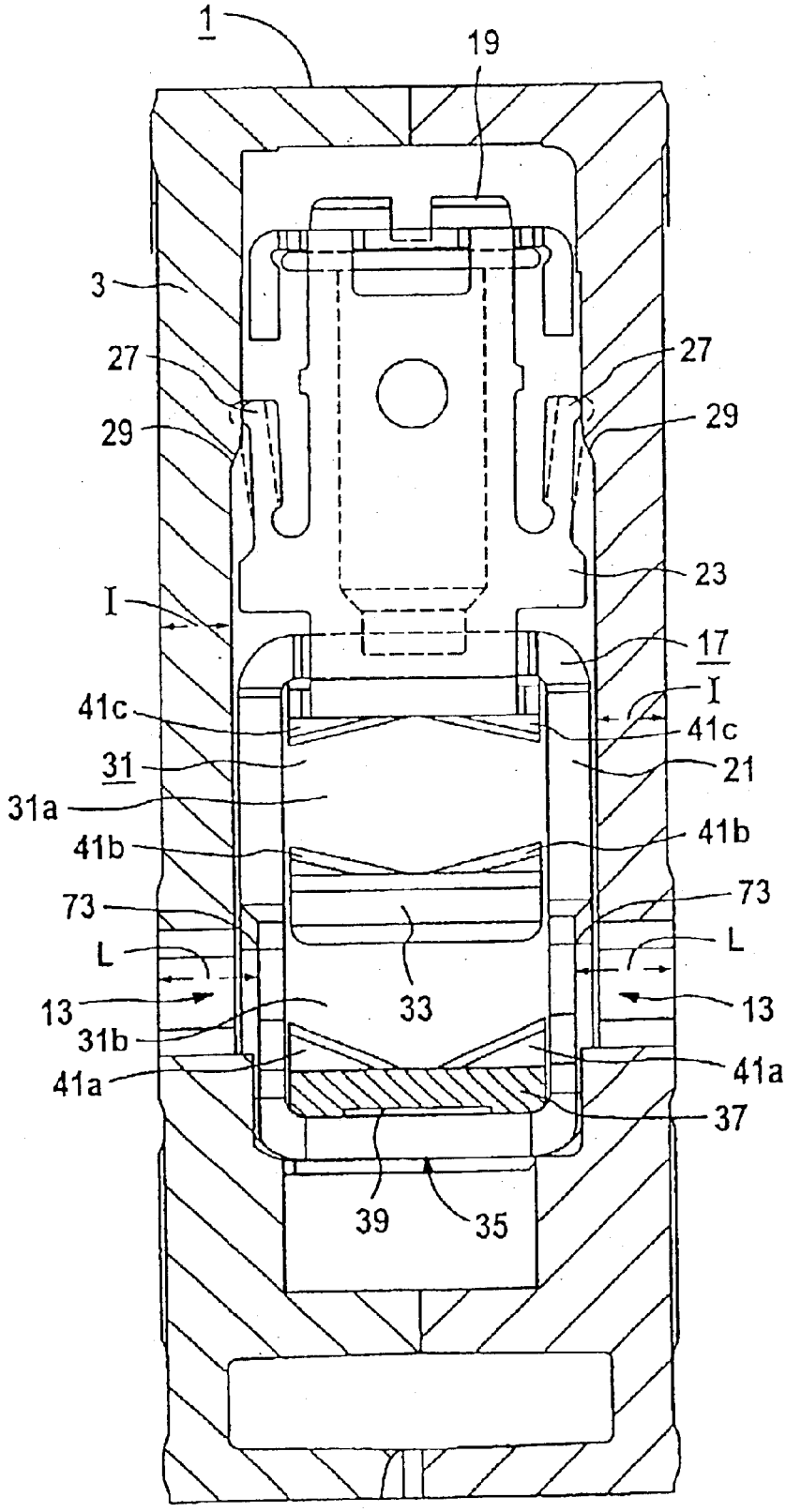
FIG. 2 illustrates a longitudinal section through the circuit-breaker according to FIG. 1 in the region of a connection terminal.

FIG. 2 shows the modular device 1 in longitudinal section in the region of the terminal 17. The terminal 17 has a clamping screw 19, by which a clamping frame 21 is connected to a pressure plate 23 in such a way that it is displaceable with respect to it. For receiving the busbar already mentioned above, the clamping frame 21 has a passage through from the first recess 13 on both its opposite side walls 22. The terminal 17 is generally constructed in the manner of an elevator terminal.

The pressure plate has in the present case, optionally on both sides, clamping feet 27, which are provided for forming vibration protection. This is so because the housing 3 has in its upper region (in the region of the pressure plate 23) a narrowed inner space, beginning in the region of the bevels 29. The clamping feet 27, splayed out in a spring-like manner, consequently allow clamping of the pressure plate 23 in the upper region of the housing.

Protruding from the inner side of the housing 3 (from the side facing away from the viewer) into the receiving space 31 of the terminal 17 is an intermediate piece 33, which makes it possible for the receiving space 31 to be divided into two part-spaces 31*a*, 31*b*. The intermediate piece 33 in this case serves at the same time for connecting the terminal 17 to an electric circuit (not shown any more precisely) within the housing 3. As mentioned above, this circuit may, for example, comprise a function as a circuit-breaker or residual-current-operated circuit-breaker. The intermediate piece 33 will be considered again later in the sectional representation according to FIG. 9.

The clamping frame 21 has on the bottom side a connecting location 35. In principle, the (clamping frame 21 is produced from a material in strip form, in particular a metallic material. The connecting location is in this case preferably formed as a clinched or clamped connection. In the simplest case, however, it is also conceivable for the two ends, abutting here, of the material in strip form just to end against each other or overlap each other, without a connecting location which can be subjected to tensile loading being formed. Consequently, "connecting location" does not necessarily mean that the ends touch each other or are frictionally connected to each other.

What is important for the present idea for this purpose is that the connecting location 35 is covered by the support 37, which on the inner space side is arranged on the clamping frame 21. As can be seen in FIG. 2, between the support 37 and the connecting location 35 there is an intermediate space 39. The support 37 consequently does not touch the connecting location 35 of the clamping frame 21. Rather, the support 37 spans the connecting location 35 in the manner of a bridge.

The following details concerning the clamping frame 21 and the support 37 apply equally and analogously to FIGS. 3 to 7. To ensure favorable contacting and centering of wires which are introduced from the direction of the viewer into the part-spaces 31*a* and 31*b*, not only the support 37 but also the intermediate piece 33 and the pressure plate 23 have elevations 41*a*, 41*b*, 41*c* which face the part-spaces and at the edges are similar to wedges. In this case, elevations lying opposite one another are designed in such a way that they engage in one another, and achieve the effect of pinching connection wires. Consequently, elevations lying opposite one another complement one another as counterparts.

Figure 3:
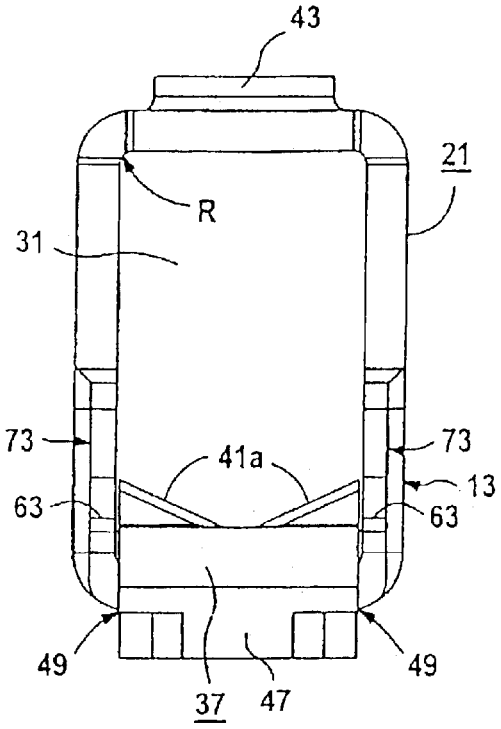
FIGS. 3 through 5 illustrate partial views of a clamping frame with an inserted support.

FIG. 3 shows the clamping frame 21 with the support 37 in an end-on view looking into the receiving space 31. The flange 43 on the top side has a thread on the inside for receiving the clamping screw 19. The support 37 may optionally overlap the end face and, if appropriate, also the rear side of the clamping frame bottom 45 in a skirt-like manner. In the region of the skirt 47, incisions 49 are provided at the sides. As a result, two lugs 51 are formed, which, when bent in, engage under the clamping frame bottom 45. In this respect, also see in particular the bottom view according to FIG. 5. In this way, the support 37 is firmly secured on the clamping frame 21.

Figure 5:
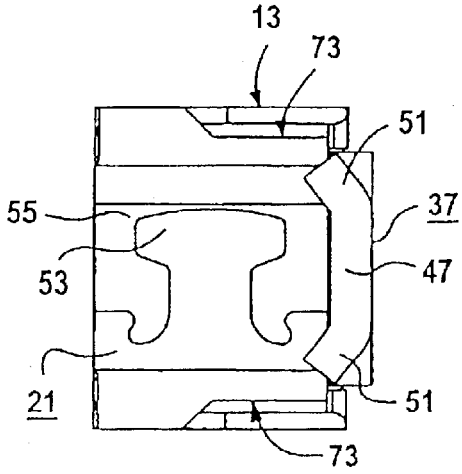

In the view according to FIG. 5, the connecting technique used here by way of example can be seen. The two ends of the clamping frame 21 in this case engage in each other by a clinching or engaging technique. For this purpose, the first end 53 has a hammerhead-like design and the second end 55 has a matching opening. Consequently, the two ends 53 and 54 are securely connected to each other in the direction of tension. It goes without saying that this connection may also be realized by other methods known from the prior art, for example a crimped or welded connection.

Figure 4:
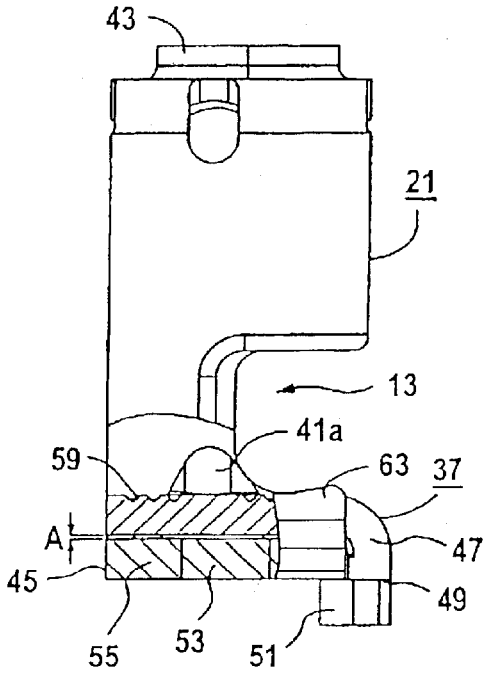

In the side view according to FIG. 4, the clamping frame 21 and support 37 are shown partly in section. Here it can be seen that between the support 37 and the clamping frame bottom 45 there is a distance A in the region of the connecting location 35. This distance preferably measures from 0.1 mm to 2.0 mm, in particular 0.2 mm.

Figure 6:
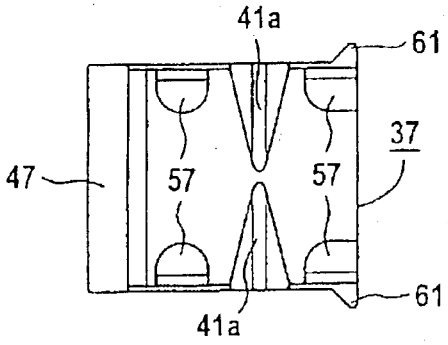
FIGS. 6 through 8 illustrate various views of the support according to FIGS. 2 through 5.

In FIG. 6, a view from below in the support 37 can be seen. The support 37 has at the edges on this underside, in particular at its four outer corners, in each case a supporting foot 57. The supporting feet 57 are dimensioned in their height in such a way that the described distance a is achieved. It goes without saying that more than four supporting feet may also be provided, or else, if appropriate, a strip at the edges. The embodiment shown here has been chosen for preference, since it can be configured as a simple punched part. The supporting feet 57 achieve the effect that a longitudinally occurring force is introduced as directly as possible into the side walls of the clamping frame 21. Loading of the connecting location 35 is consequently prevented. Alternatively, an arcuate design of the support 37 without feet is also possible.

If appropriate, the clamping frame 21, as shown at its upper corners, may have a predetermined bending radius R at the inner edges of its clamping frame bottom. If the supporting feet 57 come to lie in the region of the radius, an outwardly acting force can also be generated, if appropriate, whereby tensile loading is exerted on the connecting location 35. Consequently, the connecting location 35 is stabilized and strengthened. It goes without saying that this only applies in the case of a frictional connection of the two ends 53 and 55.

Figure 8:
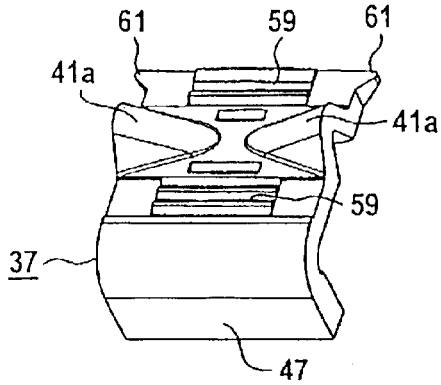
Figure 7:
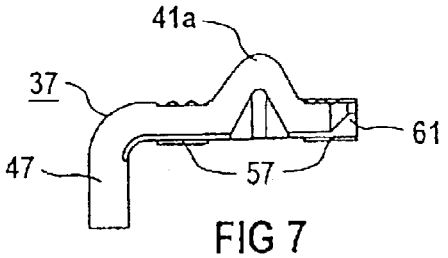

FIGS. 6 to 8 show the designs of the support 37 in detail. In particular, the three-dimensional view according to FIG. 8 gives an impression of the support. The support is in this case configured without incisions 49 and lugs 51. The wedge-like elevations 41*a* rising up to the side walls are in this case configured as an impression or shaped formation in the support 37.

In the region of the first recess 13, the support 37 has a profiling 59 in the manner of grooves or channels. This prevents inserted wires or busbars from slipping out—irrespective of the direction of insertion. This is effective for longitudinally inserted wires and for transversely inserted busbars. In the rear region, the profiling 59 is continued, so that here the effect is provided only for wires that are longitudinally pushed in.

The three-dimensional representation also clearly reveals the wedge-like elevations 41*a*, which may also be described as similar to portions of a cone. On the rear side, the support 37 has undercuts 61, so that it is held in the clamping frame 21 both from the front and from the rear side.

As already described above, the contacting area lying opposite the support 37 is configured as a counterpart to the surface of the support 37. The elevations lying opposite one another consequently engage in one another in a tooth-like manner. It is important in this case that good electrical contacting is produced along with mechanical strength for inserted wires or cables. With regard to the securing of busbars, the first recess 13 may have a hook-like elevation 63 at the edges (FIG. 4). As a result, claw-like engagement is possible in the case of a flat busbar. When using a round busbar similar to a rod, it is, as it were, embraced by the elevations 63. It is no longer possible for it simply to roll out.

Figure 9:
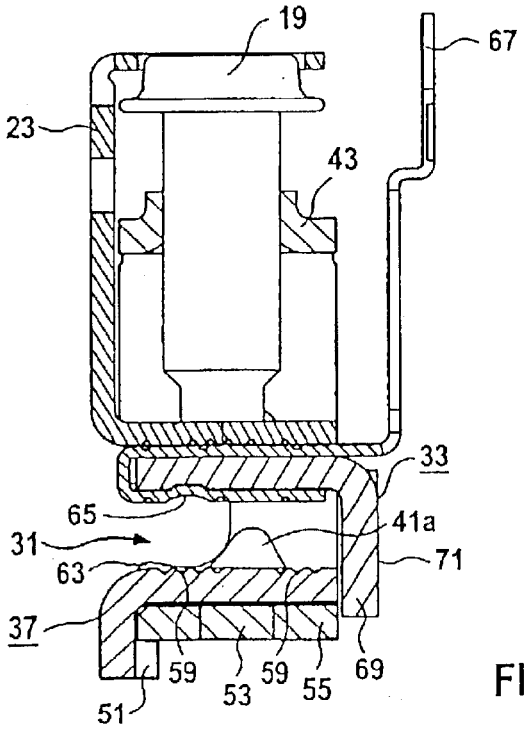
FIG. 9 illustrates a longitudinal section through a terminal.

FIG. 9 shows a partial longitudinal section through a fitted terminal. The intermediate piece 33 has on the support side a hollow 65, which likewise makes it possible in conjunction with the elevation 63 for a round busbar to be embraced.

The intermediate piece 33 shown serves on the one hand for connecting the terminal 17 to an electric circuit within the housing 3. It has for this purpose a connection tab 67. In this drawing, only a receiving space 31 is shown. By opening wide the terminal 17, the intermediate piece 33 can be centrally arranged, so that a two-part receiving space is formed in a way corresponding to FIG. 2.

According to FIG. 9, the intermediate piece 33 has a continuation 69 on the clamping frame bottom side. This continuation serves the purpose of intercepting transverse forces acting on the pressure plate 23, and consequently on the clamping screw 19. Without this continuation 69, the pressure plate 23 would become wedged or twisted when a round busbar is inserted, which in turn would result in transverse loading of the clamping screw 19 and the plastic parts surrounding it, in particular its fastening in the housing 3. In the present case, these transverse forces are directly intercepted on a short path and supported on the clamping frame 21.

To ensure a simple construction along with best-possible electrical contact, the intermediate piece 33 is constructed in two parts. On the one hand, it comprises an angle-like lower part 71. Its end on the clamping space side is in this case surrounded by a thin metal material, in particular copper, which forms the electrical contact and in its extension continues as connection tab 67. The two materials are in this case frictionally connected to each other by pressing. By this design of the intermediate piece 33, canting effects within the terminal 17 are intercepted, whereby a mechanically stable unit is formed. Consequently, an effect which damages the clamping screw 19 by canting can be prevented.

A further aspect of the novel modular device 1 is the dielectric strength in the region of the first recess 13. In principle, it is desirable to make the clamping space or receiving space 31 as large as possible. On the other hand, when devices of this type are arranged against one another in series, a predetermined air insulating gap is to be provided between exposed metal parts of devices that are adjacent to one another. This applies in particular to the region of the first recess 13, at which live parts lie in close proximity to one another when modular devices are arranged next to one another.

To ensure voltage protection, it is provided here that the clamping frame 21 is made thinner at the edges in the region of the first recess 13 than in other regions. In this case, the housing 3 may, if appropriate, be made thicker in this region, in such a way that it is adapted to the clamping frame 21. See in this respect in particular FIGS. 2 to 5, in which the design of the clamping frame 21 is shown. Within the device, that is where there is sufficient insulating capability, the housing wall is made thinner. Accordingly, the clamping frame 21 has a thicker wall thickness in this region.

This achieves the effect that, with a large receiving space and high tensile strength of the clamping frame 21—brought about by a material configuration which is strong in principle in the open connection region for busbars—, a—relatively large—clear distance is produced in conformity with regulations.

In principle, this design of the clamping frame 21 can be achieved by starting from a thin material thickness of the clamping frame 21 and then widening the latter in the closed region of the housing 3, that is bending it outward, so that it has two clear widths. In the case of the present design, it is provided that, starting from a uniform material thickness of the clamping frame 21, the latter has on the outside in the region of the first recess 13 two recesses 73. Thinning of the clamping frame 21 by a few tenths of a mm can consequently achieve the desired dielectric strength. The narrowing or thinning of the clamping frame 21 can be produced by milling out or pressing in the wall and amounts to approximately 0.5 to 3 mm, in particular approximately 1.2 mm.

According to FIG. 2, the insulating gap 1 between the outer edge of the clamping frame 21 within the housing 3 and the outer edge of the adjoining closed housing part is smaller than the air insulating gap L between the outer edge of the clamping frame 21 in the region of the first recess 13 and the outer side of the adjoining housing side.

Depending on how it is viewed, it is also possible, starting from this thin material thickness, having the insulating gap 1 with respect to the edge of the housing 3, for the design of the clamping frame 21 in the remaining closed region of the housing 3 to be regarded as widening or thickening. What is important in this case is that the clamping frame 21 is designed on the inner space side for mechanical stability and is adapted in the open edge region in combination with the wall of the housing 3 to the corresponding electrical values. In principle, it is also conceivable for the clamping frame 21 to be produced from two part-frames of different widths, so that the insulating effect described above is produced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A modular device, comprising:

a housing;

a terminal arranged in the housing, the terminal having a clamping screw, a pressure plate having a clamping frame, a first recess on a connection side thereof for transversely receiving a busbar passing through the housing and clamping frame, wherein an insulating gap between an outer edge of the clamping frame within the housing and an outer side of an adjoining closed housing side is smaller than an air insulating gap between the outer edge of the clamping frame in the region of the first recess and the outer side of the adjoining housing side.

2. The modular device as claimed in claim 1, wherein the clamping frame has a narrowing in the region of the first recess.

3. The modular device as claimed in claim 2, wherein a clamping frame width in the region of the narrowing is reduced by 0.2 to 3 mm.

4. The modular device as claimed in claim 2, wherein the narrowing is designed as a second recess.

5. The modular device as claimed claim 2, wherein the narrowing is designed as a constriction or deformation.

6. The modular device as claimed in claim 1, wherein a side wall thickness of the housing in the region of the first recess is greater than that of the closed region of the housing.

7. The modular device as claimed in claim 1, wherein the housing has on the connection side an end-face connection opening assigned to the receiving space of the terminal.

8. The modular device as claimed in claim 2, wherein a clamping frame width in the region of the narrowing is reduced by 0.7 to 1.5 mm.

9. The modular device as claimed in claim 2, wherein a clamping frame width in the region of the narrowing is reduced by about 1.2 mm.

10. The modular device as claimed in claim 3, wherein the narrowing is designed as a second recess.

11. The modular device as claimed claim 3, wherein the narrowing is designed as a constriction or deformation.

12. The modular device as claimed in claim 2, wherein a side wall thickness of the housing in the region of the first recess is greater than that of the closed region of the housing.

13. The modular device as claimed in claim 3, wherein a side wall thickness of the housing in the region of the first recess is greater than that of the closed region of the housing.

14. The modular device as claimed in claim 4, wherein a side wall thickness of the housing in the region of the first recess is greater than that of the closed region of the housing.

15. The modular device as claimed in claim 5, wherein a side wall thickness of the housing in the region of the first recess is greater than that of the closed region of the housing.

16. The modular device as claimed in claim 2, wherein the housing has on the connection side an end-face connection opening assigned to the receiving space of the terminal.

17. The modular device as claimed in claim 3, wherein the housing has on the connection side an end-face connection opening assigned to the receiving space of the terminal.

18. The modular device as claimed in claim 4, wherein the housing has on the connection side an end-face connection opening assigned to the receiving space of the terminal.

19. The modular device as claimed in claim 5, wherein the housing has on the connection side an end-face connection opening assigned to the receiving space of the terminal.

20. The modular device as claimed in claim 6, wherein the housing has on the connection side an end-face connection opening assigned to the receiving space of the terminal.

* * * * *